United States Patent [19]

Stinson

[11] Patent Number: 4,880,366

[45] Date of Patent: Nov. 14, 1989

[54] PLASTIC HAND LIFT PRESSURE PUMP

[76] Inventor: Larry A. Stinson, R. 4, P.O. Box 571, Mount Vernon, Ind. 47620

[21] Appl. No.: 240,675

[22] Filed: Sep. 6, 1988

[51] Int. Cl.[4] ..... F04B 19/22

[52] U.S. Cl. ..... 417/555.1; 137/533.11; 251/368

[58] Field of Search ..... 417/545, 555.1, 555.2; 137/533.11, 519.5, 533.13, 533.15; 251/368

[56] References Cited

U.S. PATENT DOCUMENTS

| | | | |
|---|---|---|---|
| 2,883,939 | 4/1959 | Russell | 417/555.1 |
| 3,006,282 | 10/1961 | Sisson | 417/555.1 |
| 3,124,080 | 3/1964 | Sisson | 417/555.1 |
| 4,653,989 | 3/1987 | Mason | 417/392 |

*Primary Examiner*—Carlton R. Croyle
*Assistant Examiner*—D. Scheuermann
*Attorney, Agent, or Firm*—Warren D. Flackbert

[57] ABSTRACT

A hand lift pressure pump presenting all components molded from ABS resin, PVC or other thermoplastic material so that the pump can be readily incorporated into any given installation utilizing thermoplastic conduits, fittings, adaptors and the like. In other words, the invention simplifies installation and overcomes basic difficulties in prior pumps fabricated from cast iron. The pump at hand is adapted to various end installations, including, by way of example, in connection with a driven well, a pressure system, for elevated storage and, additionally, a remote liquid or water supply, i.e. to eliminate water carrying.

1 Claim, 1 Drawing Sheet

20b
21a
21c"
20a 20b
24
24a
20b
20d
21b
21a'
21c'
21c
21a
20a'
20a
2
2
21c"
26
20c
22
20b
21d
20
3
3
24a
4
24
4
20d
20e
20f
23
25
26
26
25
10
24

12
11
14
14a

PLASTIC HAND LIFT PRESSURE PUMP

BACKGROUND OF THE INVENTION

As is known, hand operated pressure pumps, typically useful at camp sites, summer homes, livestock watering areas, rural dwellings, parks, picnic spaces and remote locations serve an important need, i.e. to eliminate water carrying. In this connection, such type of pump, primarily useful on wells, cisterns, springs, buried tanks and rivers or streams, permits water pumping, i.e. raising, to a pressure system, for elevated storage, or the like.

A need has arisen, however, for a pressure pump which is durable, readily assembled and, most importantly, compatible for usage with standard and/or common PVC pipes, fittings, connectors and the like. The invention satisfies such a need by presenting a pressure pump, formerly made, for example, from cast iron, but now importantly modified to totally utilize plastic (PVC)/ thermoplastic components. Thus, pressure capability develops at a reduced unit pump cost.

In any event, a better understanding of the present invention will become more apparent from the following description, taken in conjunction with the accompanying drawing, wherein

Figures 1, 2, 3, 4:
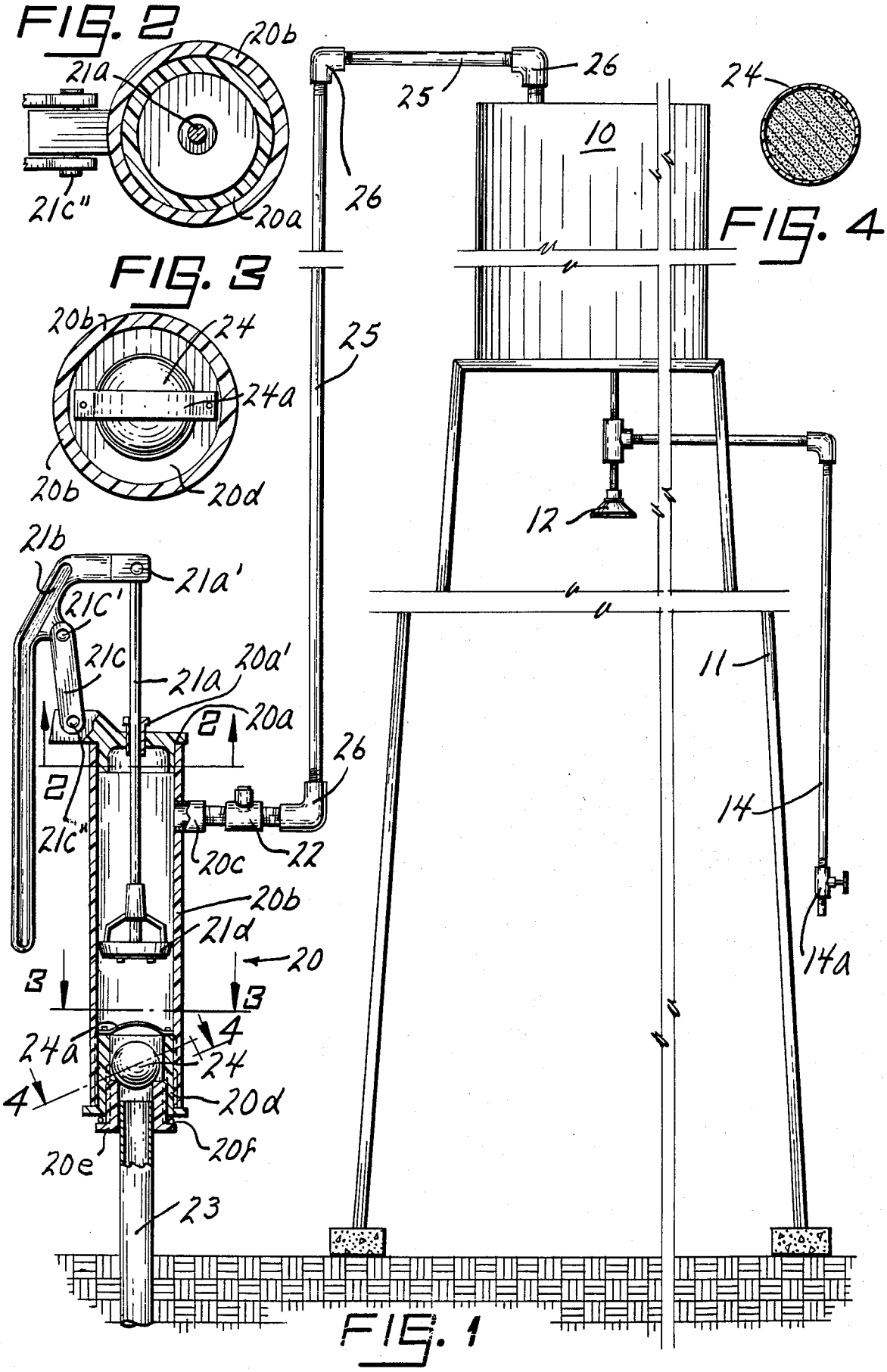
FIG. 1 is a view in side elevation, partly fragmentary and partly in vertical section, showing a typical installation utilizing a hand lift pressure pump in accordance with the teachings of the present invention.
FIG. 2 is a view in horizontal section, taken at line 2—2 on FIG. 1 and looking in the direction of the arrows, detailing the instant hand lift pressure pump.
FIG. 3 is another view in horizontal section, in this instance taken at line 3—3 on FIG. 1 and looking in the direction of the arrows, further detailing the invention.
FIG. 4 is still another view in section, in this instance being taken at line 4—4 on FIG. 1 and looking in the direction of the arrows, showing details of the ball of the built-in check valve.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the FIGS., the instant hand lift pressure pump 20 is shown in a typical use condition, i.e. in combination with an elevated storage tank 10 mounted on ground supported framework 11, and including, by way of example, a shower 12 communicating with the storage tank 10 and a conventional outlet conduit 14 with associated valve **14*a***.

Importance of the hand lift pressure pump 20 of the invention lies in the usage of components fabricated from, for example, ABS resin, PVC, or like thermoplastic material, where the arrangement presented herein thus permits ready adaption of the pump to standard and available thermoplastic (PVC) parts - which are inexpensive, readily available, easily installed, and require no particular tools or plumbing expertise.

More specifically, the instant pressure pump 20 comprises a mounting plug **20*a*, made from thermoplastic material, which is readily insertable within the upper end of a cylinder 20*b*, also made from thermoplastic material, where the mounting plug 20*a* and the cylinder 20*b* are solvent welded into position. Importantly, usage of a thermoplastic material for cylinder 20*b*** overcomes objections presented by prior pumps utilizing cast iron, with the latter material inherently promoted corrosion or rusting and, as well, made assembly into an operating installation difficult, time consuming and expensive.

In any event, plug **20*a* slidably receives, at a centrally disposed orifice 20*a*', a plunger rod 21*a*, pivotally mounted, at 21*a*', on the operating end of a handle 21*b*. A linkage assembly 21*c*, interconnects plug 20*a* and handle 21*c*, at pivot points 21*c*'and 21*c*''. The plunger rod 21*a* carries a conventional plunger assembly 21*d* at the lower free end thereof. Both the handle 21*b* and the linkage assembly 21*c*** are made from thermoplastic material.

The cylinder **20*b* mounts an outlet or discharge port 20*c*, in the form of a cylinder, disposed in a liquid flow line which includes an in-line valve 22, conduits 25 and angles 26. In that the preceding are commonly made from thermoplastic material, as PVC, assembly between each and between the outlet port 20*c*** is, as stated, readily accomplished.

The lower end of the cylinder **20*b* receives a threaded flanged bushing 20*d* into which another threaded bushing 20*e* is received. An O-ring or like sealer 20*f* is disposed between the flanges of bushings 20*d* and 20*e*. An intake conduit 23 is threadedly (not shown) received within the opening of bushing 20*e*, where the other end of intake conduit 23** extends into the ground or a source of supply.

As further evident in FIGS. 1 and 3, a built-in check valve (a polypropylene ball 24 filled with glass, inert sand or any substance heavier than water) is received within the bushing **20*d* and is seated on an O-ring (not shown) disposed on the upper end of the opening thereof. A strap member 24*a* extends across the opening in bushing 20*d*, serving to limit movement of check ball 24** during an operating mode.

Thus, the invention is unique in presenting a pump 20 wherein all of the components are made from thermoplastic material, thereby facilitating installation into any desired operating arrangement. In other words, the invention overcomes the problems inherent with prior pumps fabricated from cast iron, being particularly evidenced by mounting plug **20*a* readily assembled with cylinder 20*b*** in that each are molded from thermoplastic material.

The latter components, solvent welded into an assembled condition, are significant in the conversion of a hand lift pressure pump, operable in a known fashion, for ready accommodation into installations involving standard PVC or thermoplastic materials, as in the form of conduits, fittings, connectors, or the like.

The hand lift pressure pump described hereabove is susceptible to various changes within the spirit of the invention, including, by way of example, proportioning; the configuration of the various components; the check valve arrangement and/or assembly; and, the like. Thus, the preceding should be considered illustrative and not as limiting the scope of the following claims:

I claim:

1. A pressure pump comprising a hollow body portion having open ends and including a built-in check valve received in a bushing at one end thereof and means limiting movement of said built-in check valve, a plug member overlying said body portion and disposed within the other end thereof, a plunger rod extending through said plug member, a handle pivotally secured to an end of said plunger rod, and linkage means interconnecting said handle and said plug member, where said hollow body portion including said built-in check valve, said bushing and said limiting means, said plug member, said plunger rod, said handle and said linkage means are fabricated from thermoplastic material, and where said built-in check valve includes a mineral filled ball also fabricated from thermoplastic material.

* * * * *